United States Patent [19]

Heffentrager

[11] Patent Number: 4,537,056

[45] Date of Patent: Aug. 27, 1985

[54] ROLLING MILL

[75] Inventor: Joel L. Heffentrager, Mars, Pa.

[73] Assignee: SMS Schloemann - Siemag, Inc., Pittsburgh, Pa.

[21] Appl. No.: 557,052

[22] Filed: Dec. 1, 1983

[51] Int. Cl.[3] ..... B21B 31/12

[52] U.S. Cl. ..... 72/238

[58] Field of Search ..... 72/237, 238, 239, 244

[56] References Cited

U.S. PATENT DOCUMENTS

| | | | |
|---|---|---|---|
| 679,413 | 7/1901 | Bunker | 72/244 |
| 2,835,021 | 5/1958 | O'Malley | 72/237 X |
| 3,487,672 | 1/1970 | Sack | 72/237 X |
| 3,587,278 | 6/1971 | Kracht | 72/237 |
| 4,237,715 | 12/1980 | Lutz | 72/244 |

FOREIGN PATENT DOCUMENTS

| | | | |
|---|---|---|---|
| 1198774 | 8/1965 | Fed. Rep. of Germany | 72/237 |

*Primary Examiner*—Francis S. Husar
*Assistant Examiner*—Steven B. Katz
*Attorney, Agent, or Firm*—Clifford A. Poff; Thomas H. Murray

[57] ABSTRACT

A rolling mill is disclosed wherein mill housings have an inverted U-shape forming windows that receive chocks for roll assemblies. The windows are open at the bottoms of the housings and chocks for the lower roll assembly have lugs that project into recesses formed in the lower portions of the housing post sections and rest against removable keys supported in slots that are generally parallel to the rotational axis of the roll assembly. A platform supports the rolling mill when processing workpieces. Pad surfaces on the platform engage the lower end faces of the housing post sections and anchors engage the housing post sections at the sides thereof which are opposite the housing windows to resist a component of the rolling load transferred by the keys to the housing post sections.

12 Claims, 7 Drawing Figures

ROLLING MILL

BACKGROUND OF THE INVENTION

This invention relates to an improved rolling mill construction wherein bearing chocks for at least a pair of rolls are supported in windows of a pair of housings each having an inverted U-shaped configuration and provided with removable bars to transfer the rolling load from the chocks of the lower roll to post sections of the housings.

A pair of cast mill housings is usually provided to support and resist the separating or rolling forces on roll assemblies for processing workpieces. A 2-high or a 4-high rolling mill is selected on the basis of the rolling loads and the shape of the workpiece. Because of the tremendous separating force that develops between the rolls when processing workpieces, the mill housings usually take the form of massive unitary castings each having a machined window for supporting the bearing chocks of the roll assemblies. A screwdown or other form of adjusting means is built in the housings to establish a roll gap by positioning the chocks for one of the rolls relative to the remaining roll assembly. When a screwdown is used, nuts are supported in bored openings in housing top crossmembers and screws are rotated through the nuts so that the screw ends extend into engagement with the chocks of the upper roll assembly. At the bottom of the housing, there is a housing crossmember that supports the chocks for the lower roll assembly. Housing post sections extend between the top and bottom housing crossmembers. In a 4-high rolling mill, a pair of work rolls is supported by the upper and lower roll assemblies.

In a 2-high rolling mill, for example, it is known in the art to reduce the weight of the mill by forming the housings from machined thick metal plates rather than from castings. The housing made from metal plates can withstand the same or even greater rolling loads. Usually, rolling mill housings can be more economically produced from machined plates than castings. The weight of a rolling mill, principally comprised of roll assemblies and mill housings, is reduced according to the present invention by an improved rolling mill design to meet the need to operate a rolling mill facility which is severely restricted by the capacity of a mill crane. The unique rolling mill design has general utility due to a lower capital investment provided thereby as compared with a conventional rolling mill construction. Moreover, roll-changing operations are simplified by the use of a crane to assemble the mill stand, to change rolls and to perform maintenance operations.

SUMMARY OF THE INVENTION

It is, therefore, an object of the present invention to provide a rolling mill in which the weight thereof is minimized by a construction and relationship of parts forming the rolling mill housings and roll assemblies therefor.

It is a further object of the present invention to provide a rolling mill embodying a construction and relationship of parts to improve the replacement of worn roll assemblies with refurbished roll assemblies in mill housings wherein the entire rolling mill is moved from its normally-operative position in a rolling mill installation to some other designated site for the roll-changing procedure.

More particularly, according to the present invention there is provided a rolling mill including the combination of a pair of inverted U-shaped housings each having two housing post sections depending from a top beam section forming a window which is open at the bottom of the housing post sections, upper and lower roll assemblies each having spaced-apart journals rotatably supported by bearing chocks, removable means on the lower end portions of the housing post sections for transferring a rolling load from the bearing chocks of the lower roll assembly to the housing post sections, the removable means being movable to a position to allow the bearing chocks for the lower roll assembly to pass from the housing windows beyond the lower ends of the housing post sections, and means for supporting the housings while carrying the roll assemblies.

The aforementioned removable means preferably take the form of four elongated bars that can slide into correspondingly-shaped slots arranged in a horizontal plane in the lower end portions of the housing post sections. The housing post sections can be provided with vertically-arranged recesses extending to the housing windows for receiving protruding lugs from the opposite sides of the chocks for the lower roll assembly. The lugs engage with the bars in the housings to thereby transfer the rolling load from the chocks to the housings. The means for supporting the housings in one aspect of the invention are pad surfaces on a platform used to support the rolling mill housing at a location for processing workpieces. Upstanding on the platform are anchor members that engage the sides of the housing post sections opposite the window openings to anchor the housings at a fixed location while at the same time preventing spreading of the lower ends of the housing post sections. The lower ends of the housing post sections are not tied together in the usual fashion by a lower crossbeam section. The anchor members on the platform for each housing preferably include a movable wedge supported by a wedge surface on a stationary wedge member. Spacer rods maintain the lower end portions of the housings at a predetermined spaced-apart relation and a spacer beam interconnets crossheads at the tops of the housing for the same purpose. Means for adjusting the top roll assembly relative to the lower roll assembly is provided and such means may take the form of a screwdown assembly supported by a top beam section. However, other well-known forms of roll-adjusting means may be used.

According to another aspect of the present invention, the aforesaid means for supporting the housings takes the form of a roll-changing platform having support pads that are spaced apart to engage with the lower end surfaces of the housing post sections. Between the support pads for each housing post section, there are upstanding rail members to engage with the chocks of the lower roll assembly. An actuator, such as a screw-type jack, is also supported on the platform between the rails to engage with a chock for the lower roll. The actuator can be operated to lift the chock for the lower roll assembly as well as the upper roll assembly in the mill housing for establishing an operating clearance between the protruding lugs and the removable bars. In this way, the bars are relieved of a clamping force established by the weight of the roll assemblies which normally holds the bars in place in the slots. The removable bars can thereby be removed after which the roll assemblies are lowered by operation of the jacks for reengagement and support by the rails. Thereafter, the housings can be lifted by a crane from the roll assemblies which remain on the platform. The roll assemblies can then be refurbished. The refurbished roll assemblies will again be supported on the rails of the roll-changing platform and the housing assemblies therewith by carrying out the disassembling operation in reverse.

These features and advantages of the present invention as well as others will be more fully understood when the following description is read in light of the accompanying drawings, in which.

Figure 2:
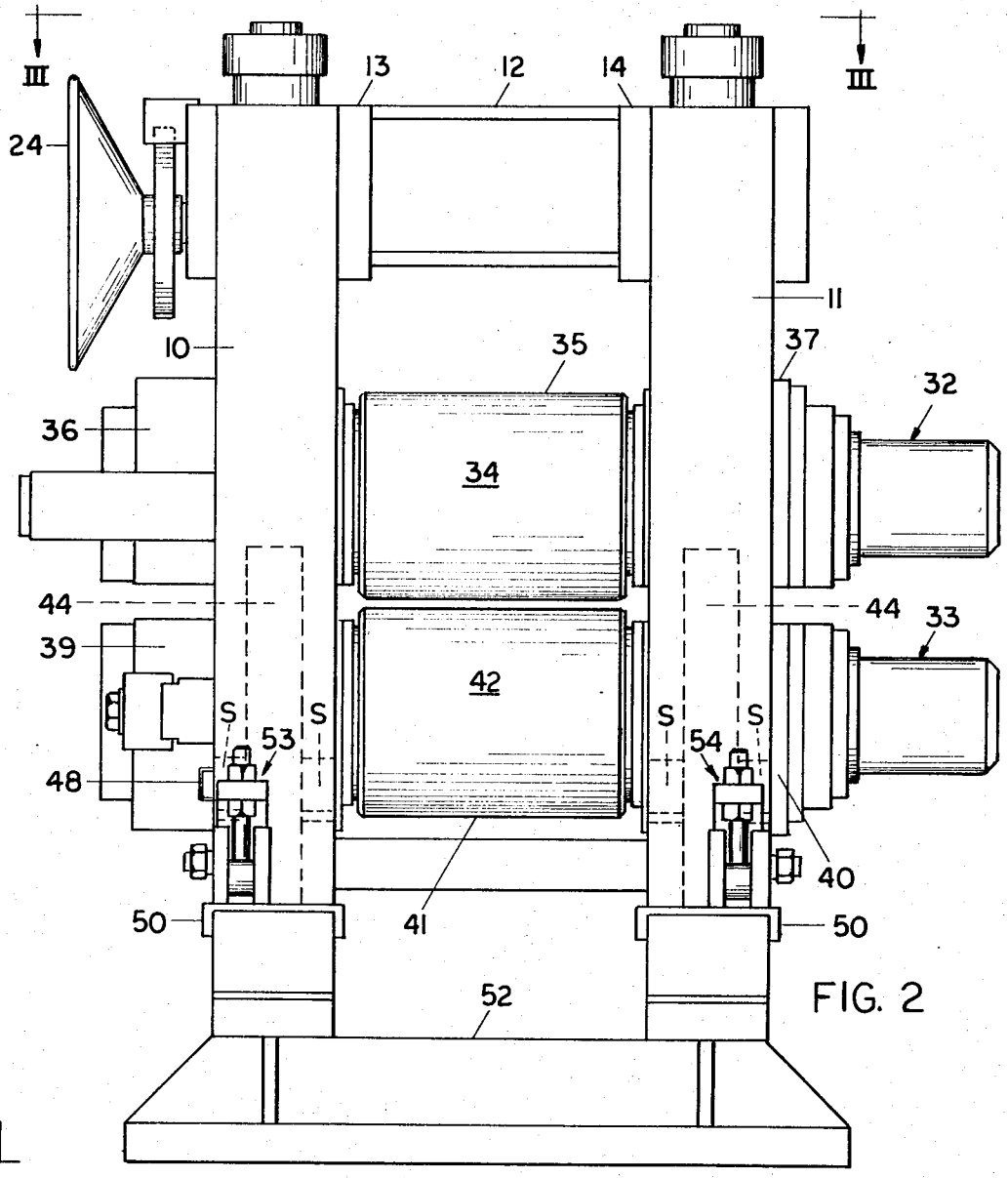
FIG. 2 is a front elevational view of the rolling mill shown in FIG. 1.
Figure 1:
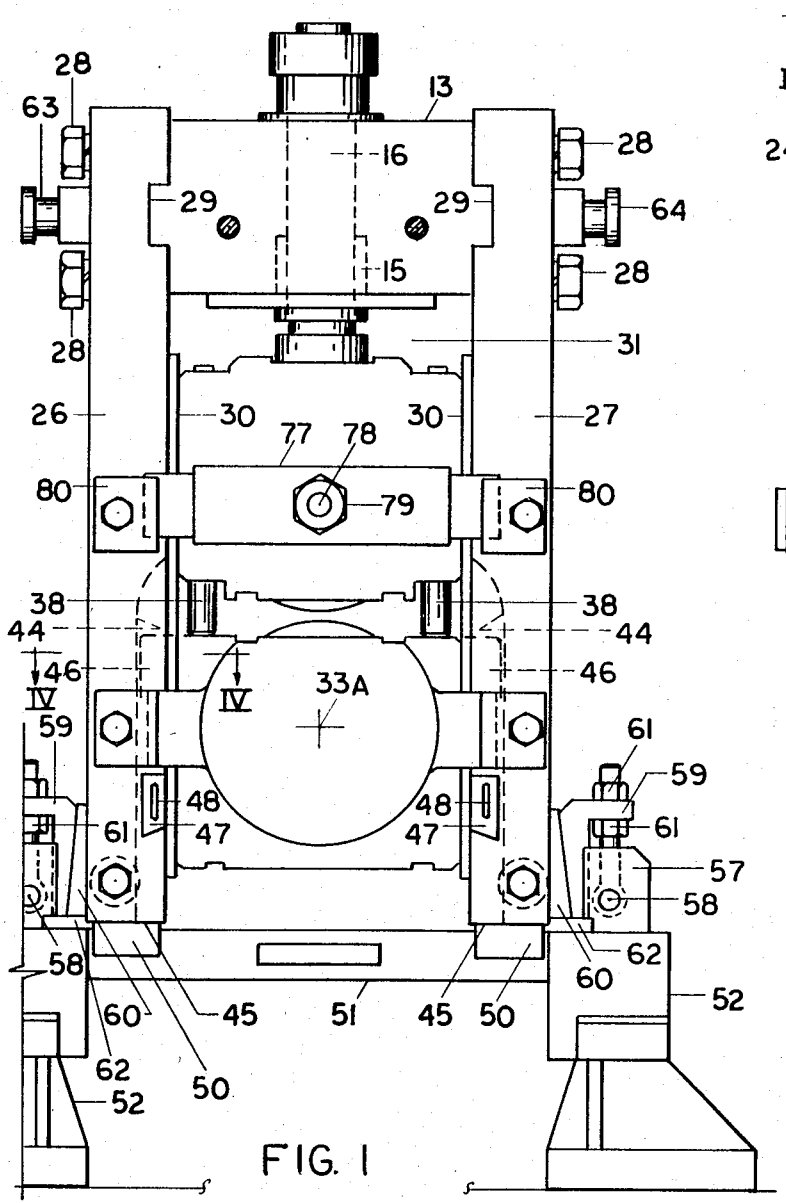
FIG. 1 is an end elevational view at the operator's side of a rolling mill embodying the features of the present invention.
Figure 5:
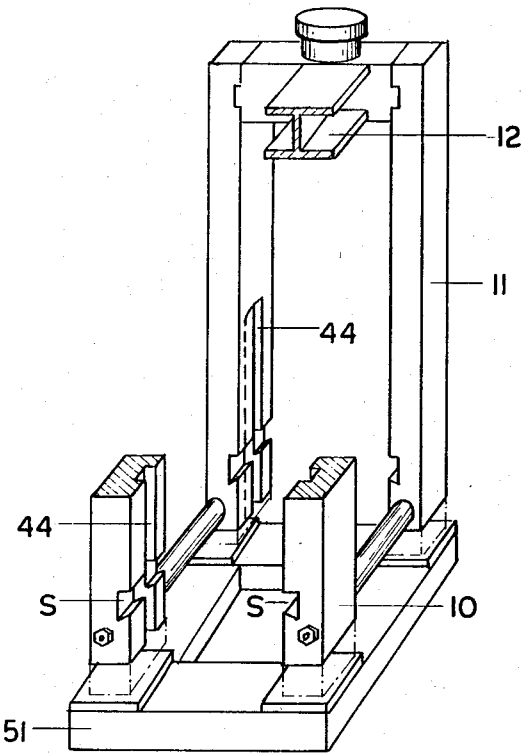
FIG. 5 is an isometric view of the mill housings for the rolling mill shown in FIGS. 1–4.
Figure 3:
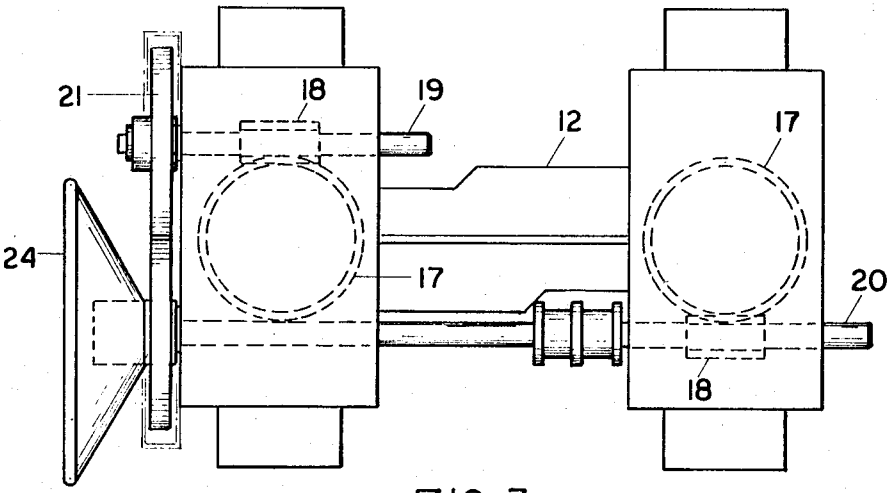
FIG. 3 is a top view taken along line III—III of FIG. 2.

As shown in FIGS. 1–3 of the drawings, the preferred embodiment of the rolling mill according to the present invention includes a pair of spaced-apart rolling mill housings 10 and 11 each of which comprises an assembly of parts forming an inverted U-shaped configuration. A crossbeam 12 is attached, e.g., by bolts, to crossheads 13 and 14 which are part of the housing assemblies 10 and 11, respectively. Screwdowns are incorporated in each crosshead by providing a vertical opening wherein a nut 15 is supported against rotation by a key member, not shown, and receives a screw 16. On the upper portion of each screw which protrudes from the top of the crosshead, there is secured a gear wheel 17 having gear teeth that mesh with a pinion 18. The pinions 18 for the screwdowns are connected with drive shafts 19 and 20 which extend to the operator's side of the rolling mill. Shafts 19 and 20 are drivingly interconnected by spur gears 21 and 22.

As shown in FIG. 3, a hub portion 23 of spur gear 22 is provided with a handwheel 24. By rotating the handwheel 24 in one direction, both screws 16 will be withdrawn simultaneously upwardly from the nuts; whereas rotation of the handwheel in the opposite direction moves the screws in unison downwardly in the crossheads. Each rolling mill housing assembly further includes two downwardly-extending housing post sections 26 and 27 that are connected at their upper ends to the crossheads by bolts 28. In addition to the bolts 28, recesses 29 are formed in each of the housing post sections into which protruding key sections on the opposite sides of the crossheads 13 are received. Spacer bars interconnect the lower ends of post sections 26 and 27. The housing post sections 26 and 27 of each mill housing have liners 30 that establish housing windows 31 in the mill housings 10 and 11 for receiving upper and lower roll assemblies 32 and 33. The upper roll assembly includes a roll 34 having a body portion 35 which is grooved in a well-known manner. At opposite sides of the body portion 35 there are the usual journals that are rotatably supported by bearing chocks 36 and 37. Roll-balance cylinders 38 are mounted in the chocks for the upper roll assembly and extend into engagement with chocks 39 and 40 mounted on journals at opposite sides of a roll body 41 of the lower roll 42 forming the lower roll assembly 33.

Figure 4:
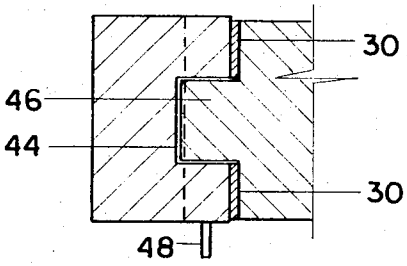
FIG. 4 is an enlarged sectional view taken along line IV—IV of FIG. 1.

Each of the housing post section 26 or 27 for the mill housings includes an elongated recess 44 that is open to the windows 31 by vertical slots in the liners 30. As shown in FIG. 4, recesses 44 in the housing post sections are sufficiently large to form clearances that facilitate assembling of protruding lugs 46 in the recesses. The lugs 46 extend from opposite side surfaces of the bearing chocks 39 and 40 for the lower roll assembly 33. The recesses 44 are elongated to extend from points in a horizontal plane generally above the operative position of the lower roll assembly downwardly where the recesses open out of the end surfaces 45 of the housing post sections.

The present invention provides that the lower portion of each housing post section 26 or 27 of each mill housing includes a generally horizontal slot S traversing the recesses 44 in the housing post sections. Each slot S lies in a generally horizontal plane that is parallel to a rotational axis 33A of the lower roll assembly. Each slot can receive a generally rectangularly-shaped key 47 that is conveniently provided with a U-shaped handle 48 to facilitate insertion and removal of the key in the slot. The keys, when situated in the slots of the mill housing, protrude across the vertically-arranged recesses 44 to engage the lugs 46 and prevent downward movement of the chocks from the housing window. By this arrangement of parts, the rolling forces on the lower roll assembly are transferred to the housing post sections. In FIG. 1 of the drawings, the lower surface of each key 47 is inclined to horizontal to maintain a tight-fitting relationship between the slot and the key under the rolling load which is transmitted to the housing post sections by the key from the roll chocks 39 and 40

End surfaces 45 on the lower ends of the housing post sections rest on individual pad members 50 that are supported by a platform 51. The platform is connected to a piston and cylinder assembly, not shown, to slide the rolling mill stand back and forth in a direction parallel to axis 33A for aligning roll-pass openings when such are provided in the rolls for processing rods or similar workpieces. The platform 51 slides on bedplates 52 that are spaced apart and extend transversely to the pass line in the rolling mill assembly. Each of the rolling mill housings is clamped between upstanding anchors 53 and 54 which, as shown in FIG. 1, engage the lower end portions of the housing post sections at the sides thereof which are opposite the face surfaces of the housing post sections directed toward the window. When it is unnecessary to move the rolling mill stand back and forth, the platform 51 can be eliminated and anchors 53 and 54 can be applied directly to the bedplates. The anchors 53 and 54 cooperate to prevent lateral spreading of the lower ends of the housing post sections which may otherwise occur as the rolling forces are transferred from the roll chocks to the housing post sections by the key members. The anchors are designed to hold the roll stand firmly on the pad member 50 and thereby prevent tilting or lifting of the mill stand on the platform 51. Each of the anchors 53 and 54 is an assembly including an anchor block 57 affixed to the top surface of the platform and carrying a pivot 58. Anchor block 57 has side walls forming a hollow interior wherein an eyebolt is connected by pin 58 to the support. The eyebolt extends vertically where a threaded shank portion thereof receives a support lug 59 of a movable wedge block 60.

Nut members 61 engage the threaded portion of the eyebolt at opposite sides of the lug 59 to adjustably affix the position of the wedge block 60. The inclined surface of wedge block 60 diverges in a downward direction away from the housing post sections and engages with a wedge surface on a wedge block 62 affixed to the housing post section.

A nut member 61 above each movable wedge block 60 is raised on the threaded portion of the eyebolt so that the eyebolt can pivot away from the mill stand and the wedge withdrawn. The entire rolling mill can now be removed from the support pads 50 for purpose of replacing the roll assemblies thereof. In place of the eyebolt, the wedge block 60 can be positioned by a hydraulic actuator or other means to releasably hold the mill stand on the platform 51. The mill housings which are preferably fabricated from metal plates can be produced with a very favorable strength-to-weight ratio whereby the weight of the housings can be less than the roll assemblies for a given rolling mill installation. This is contrary to most rolling mill constructions, particularly those utilizing housings made from castings. Absent from the rolling mill housing of the present invention is the usual crosshead at the bottom of the housing post sections traditionally used as a support for the chocks of the lower roll assembly for transferring the separating force to the housing post sections. The use of the keys according to the present invention to transfer the rolling load to the housing post sections not only greatly reduces the weight of the mill housings but also the absence of a bottom cross section to the mill housings permits greatly improved roll-changing operations. As described above, the anchor assemblies 53 and 54 absorb separating forces tending to spread the lower ends of the housing post sections. These separating forces are normally very small in relation to the rolling load and can be effectively resisted by the platform 51.

Figure 6:
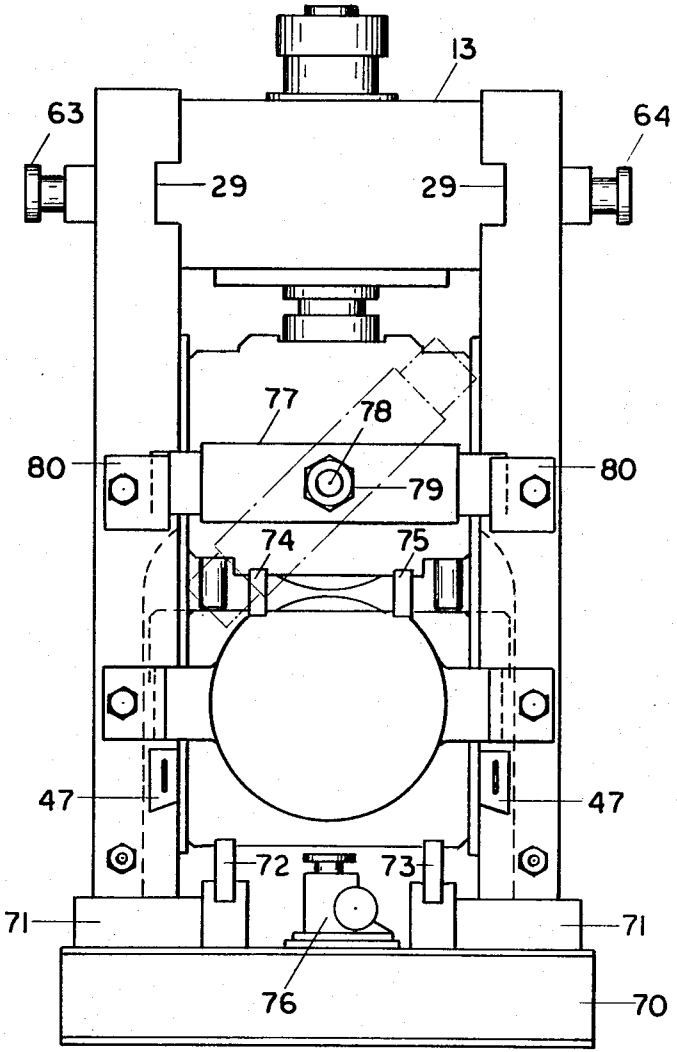
FIG. 6 is an elevational view similar to FIG. 1 but illustrating a roll-changing platform for carrying out the roll-changing operations for the rolling mill stand.

To carry out the roll-changing operation, lugs 63 and 64 are disposed on opposite sides of each mill housing at the top thereof for providing a suitable support surface that can be engaged by a sling on the hook of a crane. After the usual hydraulic, lubrication and roll-drive spindles have been disconnected from the mill, the entire rolling mill assembly can be lifted from the platform and placed on a roll-changing platform 70 as shown in FIG. 6. Platform 70 carries four support pads 71 that are spaced apart by distances corresponding to the distances between the housing post sections of the mill housings. Upstanding rails 72 and 73 extend generally parallel to the rotational axis 33A and engage with the bottom surface of the lower roll chocks. Spacers 74 and 75 are placed between the upper and lower roll chocks to maintain a gap between the body portions of the roll assemblies. These spacers can be installed before transporting the rolling mill to the roll-changing platform and before the hydraulic lines are disconnected for the roll-balance cylinders. This enables the use of the roll-balance cylinders to lift the upper roll assembly in the housing window a sufficient distance to permit the installation of the spacer blocks. However, if desired, the spacer blocks may be installed while the rolling mill is situated on the roll-changing platform by temporarily connecting the hydraulic lines to the roll-balance cylinders to lift the upper roll assembly.

Figure 7:
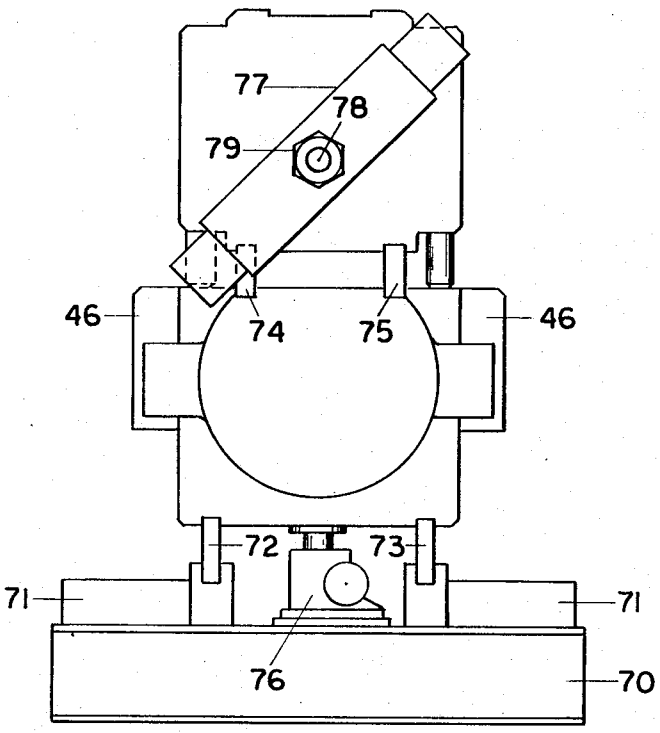
FIG. 7 is a view similar to FIG. 6 but illustrating only roll assemblies on the roll-changing platform.

Two mechanical jacks 76 are spaced apart and supported by the roll-changing platform at a location between the rails 72 and 73 to engage the bottom surface of the chocks for the lower roll assembly. The jacks are operated to temporarily lift the lower roll assembly and thereby also the upper roll assembly in the mill housing a short distance which can be as small as one-eighth of an inch to establish a clearance between the lugs 46 projecting from the chocks of the lower roll assembly and the keys 47. In this way, the keys can be freely withdrawn whereupon the jacks are again operated to lower the lower roll chocks onto rails 72 and 73. At the operator's side of the mill, an anchor 77 is provided for the top roll assembly to absorb thrust forces occurring in a direction parallel to the rotational axis of the upper roll. The bar is rotatably supported on a shaft 78 extending from the upper roll chock and attached by a nut 79. The bar is anchored to the housing post sections by keeper plates 80 but can be released from the keeper plates by rotating the bar on shaft 78 to a position indicated by phantom lines in FIG. 6. The mill housings can now be lifted from the roll assemblies and supported at some predetermined adjacent site. The upper and lower roll assemblies remain on the roll-changing platform as shown in FIG. 7. The top roll assembly can then be removed and then the lower roll assembly removed for refurbishing.

After refurbishing or if a replacement pair of rolls is provided, they are placed on the roll-changing platform by first arranging the lower roll assembly such that its chocks are supported on rails 72 and 73. Thereafter, spacers 74 and 75 are placed on the top surface of the chocks for the lower roll assembly and the top roll assembly is supported on the spacers. The mill housings can then be returned to the roll-changing platform where the open bottoms of the housing windows form entry sites for the chocks of the upper roll assembly. As the mill housings are lowered, the lugs 46 projecting from the lateral sides of the lower roll chocks enter the recesses 44 in the mill housings and slide therealong until the bottom end faces of the housing post sections engage the support pad 71. The mechanical jacks 76 are again energized to lift the roll assemblies such that the keys 47 can be reinserted with unimpeded movement of the slots. The jacks are then operated in reverse to lower the roll assemblies for support on the rails 72 and 73. Bar 77 can be moved into its operative position where it engages keeper plates 80. The rolling mill stand can now be returned to the rolling mill installation for support on platform 51.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A rolling mill comprising:

upper and lower roll assemblies each including a roll having a journal at each of opposite ends thereof received in a bearing chock, a pair of inverted U-shaped housings each having two housing post sections depending from a top beam section forming a window to receive the bearing chock at one end of each roll for support thereby, each window being open at the bottom of the housing post sections to permit the chocks of at least the lower roll assembly to move into and out of the windows of the housings, by moving the housings relative to the chocks of the lower roll assembly load transfer means removably mounted on the lower end portions of said housing post sections for transferring a rolling load from the bearing chocks of said lower roll assembly to the housing post sections, said load transfer means being movable to a position out of engagement with the bearing chocks for the lower roll assembly to allow the roll assembly to pass from the housing windows beyond the lower ends of the housing post sections, and first platform means removably mounting said post sections for supporting said housings with said roll assemblies while in a normally operative position.

2. The rolling mill according to claim 1 wherein said load transfer means engages said housing post sections at a fixed elevation along the window of each of said housings.

3. The rolling mill according to claim 1 wherein said first platform means for supporting includes members to engage with the housing post sections for resisting deflection thereof away from the bearing chocks of the lower roll assembly while engaged with said load transfer means in the windows.

4. The rolling mill according to claim 1 further including means supported by top beam sections of said housings for adjustably positioning said upper roll assembly relative to said lower roll assembly.

5. The rolling mill according to claim 1 wherein said load transfer means includes elongated bars, and wherein lower end portions of said housing post sections include slots extending in the housing window parallel to the pass line for supporting said elongated bars.

6. The rolling mill according to claim 1 wherein said first platform means for supporting includes support pads to engage the lower ends of said housing post sections, and wedge support means arranged to engage the housing post sections opposite said windows.

7. The rolling mill according to claim 1 wherein each of the bearing chocks of said lower roll assembly includes lugs protruding from opposite sides thereof for engaging said load transfer means.

8. The rolling mill according to claim 7 wherein each of said housing post sections has an elongated slot facing the window formed by the housings for slideably receiving said lugs

9. The rolling mill according to claim 1 wherein said first platform means for supporting includes a platform having support pads to engage with the lower ends of said housing post sections.

10. The rolling mill according to claim 9 wherein said first platform means for supporting further includes anchor members to releasably fasten said housings to said platform.

11. The rolling mill according to claim 9 further including a roll changing platform removably mounting said housing posts, said roll changing platform including upstanding rail members for supporting said chocks when carried thereto from said first platform.

12. The rolling mill according to claim 11 further including means on said roll changing platform for lifting the bearing chocks of said lower roll assembly within said housing window from engagement with said load transfer means to permit removal thereof from the housings.

* * * * *